United States Patent [19]

Schroeder

[11] Patent Number: 5,005,477

[45] Date of Patent: Apr. 9, 1991

[54] DOUBLE TRUCK PRINTING REGISTRATION SYSTEM FOR A ROTARY PRINTING PRESS

[75] Inventor: Richard B. Schroeder, Wilmington, Del.

[73] Assignee: Hercules, Incorporated, Wilmington, Del.

[21] Appl. No.: 466,014

[22] Filed: Jan. 16, 1990

Related U.S. Application Data

[63] Continuation-in-part of Ser. No. 298,988, Jan. 19, 1989.

[51] Int. Cl.[5] ..... B41F 27/06; B41F 27/12

[52] U.S. Cl. ..... 101/415.1

[58] Field of Search ..... 101/415.1, 378, DIG. 36

[56] References Cited

U.S. PATENT DOCUMENTS

| | | | |
|---|---|---|---|
| 3,858,512 | 1/1975 | Simeth | 101/DIG. 36 |
| 3,882,775 | 3/1990 | Lytle et al. | 101/415.1 |
| 4,603,641 | 8/1986 | Jeschke et al. | 101/415.1 |

*Primary Examiner*—J. Reed Fisher

*Attorney, Agent, or Firm*—Connolly & Hutz

[57] ABSTRACT

A rotary printing press is used for printing standard pages and for double truck printing of the centerfold page. This is accomplished by mounting side by side printing plates to locking devices in the rotary printing press. The printing plates are positioned by two registrations which are selectively movable toward and away from each other to one of at least two predetermined fixed positions. In one of the fixed positions, the standard printing takes place, and in the other fixed position, the printing press is used for double truck printing.

3 Claims, 7 Drawing Sheets

DOUBLE TRUCK PRINTING REGISTRATION SYSTEM FOR A ROTARY PRINTING PRESS

CROSS-REFERENCE TO RELATED APPLICATION

This application is a continuation-in-part of application Ser. No. 298,988, filed Jan. 19, 1989.

BACKGROUND OF INVENTION

Rotary printing presses are used for various purposes including newspaper printing. Each section of a newspaper is comprised of standard pages wherein a margin exists along the sides of each page. The centerfold page however does not require a margin and in fact it is sometimes desirable that there be no margin so that various printed material could span the central area of the centerfold page and print a continuous image. Heretofore, the prior art has printed newspapers by utilizing conventional techniques for printing the standard pages. When the double truck page is printed, however, it is necessary to have each half of the centerfold butted together. This is conventionally done manually with special equipment and involves such manual activities as sheering, trimming and punching. Such equipment is quite costly, being about $40,000, in addition to requiring the great manual effort.

SUMMARY OF INVENTION

An object of this invention is to provide a rotary printing press which is capable of printing both standard pages and double truck pages without requiring the great manual efforts or equipment costs heretofore required.

In accordance with this invention, the rotary printing press includes at least two plate locking devices for releaseably locking side by side printing plates to the plate cylinder. Each plate locking device include registration means to properly orient each printing plate. The registration means are mounted in such a manner as to be slightly shiftable to one of two predetermined fixed positions. In one of these positions the registration means of the two adjacent locking devices are shifted away from each other and the printing press is used for printing standard pages. In the other of the two positions, where the registration means are moved toward each other the printing press is used for double truck printing.

In a preferred embodiment of this invention the registration means is in the form of a registration plate having an offset generally perpendicular flange which is secured by a fastener to the housing of the plate locking device. The opposite end of the registration plate includes plate registration structure. The printing plate would have complementary structure to properly orient the printing plate. The fastener could be manipulated so that the registration plate can be shifted to one of the two positions in accordance with the type of printing being performed. The fastener would then be tightened to lock the registration plate in that position.

THE DRAWINGS

DETAILED DESCRIPTION

Figure 1:
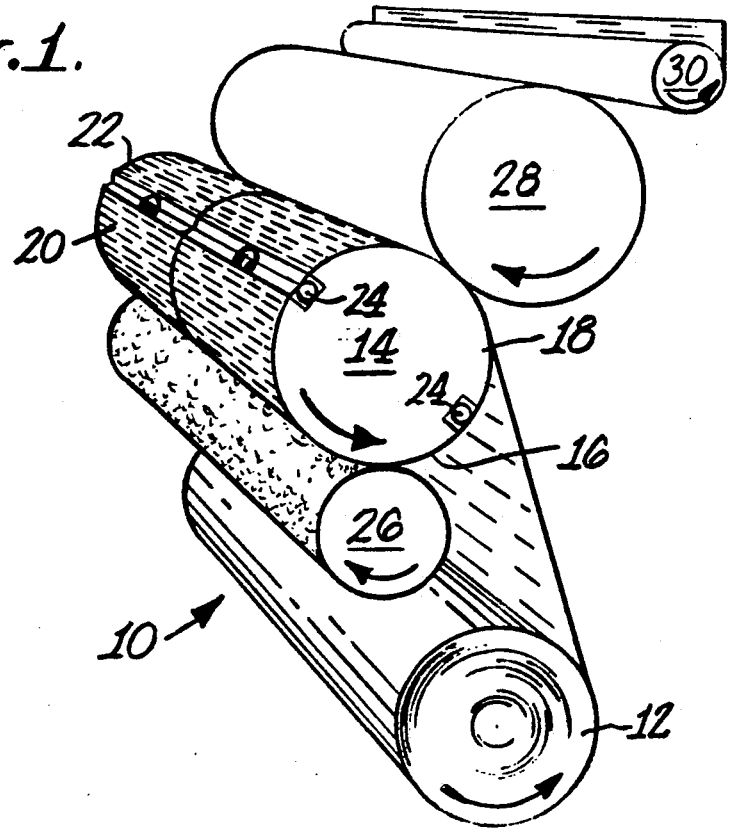
FIG. 1 is a perspective view showing a rotary printing press in accordance with this invention.

FIG. 1 illustrates a rotary printing press 10 in accordance with this invention. As shown therein printing press 10 includes a roll of paper supply 12 which may be used for printing newspapers. Printing press 10 also includes plate cylinder 14. Plate cylinder 14 may be considered as being in two sections for mounting side by side printing plates which are used for printing the newspapers. In the embodiment illustrated in FIG. 1, two such printing plates 16,18 are secured to one section of plate cylinder 14 while a corresponding pair of printing plates 20,22 is secured to the other half or section of plate cylinder 14. The printing plates are secured to the plate cylinder by sets of plate locks 24,24. Plate locks 24,24 may be of any suitable construction. For example, the plate locks may be of the known Barenschee Universal Torsion Cylinder Plate Lock construction. The plate locks may also be of the form described in my patent application Ser. No. 65,951 filed June 24, 1987 the details of which are incorporated herein by reference thereto.

Rotary printing press 10 also includes an ink cylinder 26 and an impression cylinder 28 as well as backing roll 30.

It is to be understood that the press 10 illustrated in FIG. 1 is merely exemplary and other forms of presses may be used with the invention.

Figure 2:
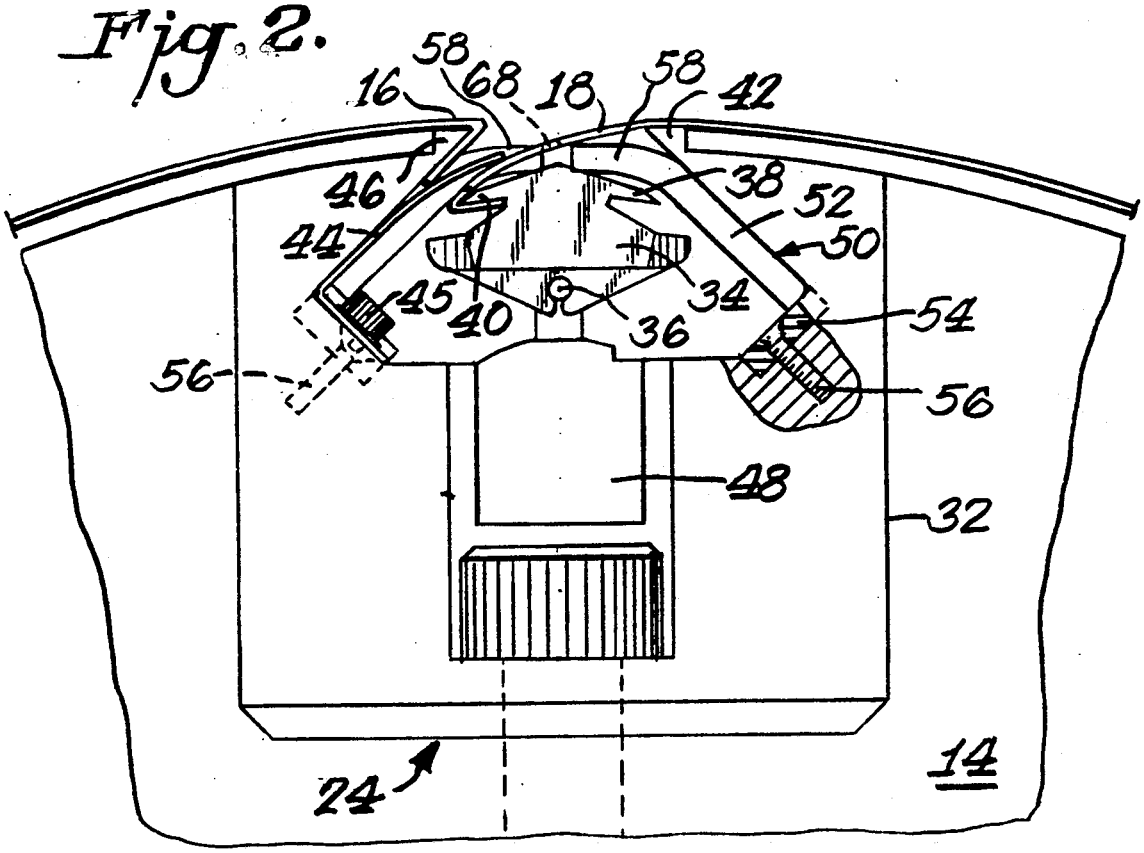
FIG. 2 is an end elevation view, partly in section of a portion of the printing press shown in FIG. 1.

FIG. 2 illustrates in greater detail the structure of plate lock 24. Plate cylinder 14 would be provided with four of these plate locks with a pair of plate locks aligned with each other and diametrically opposite the other pair. (See FIG. 1) As shown in FIG. 2 each plate lock 24 is in the form of, for example, a metal housing 32 which is mounted in a channel in plate cylinder 14. The particular plate lock 24 illustrated in FIG. 2 is of the K&F FLEX LOCK Cylinder Plate Lock construction and includes a spindle 34 pivotally mounted on fixed shaft 36 which is secured to bar 48. A spring, not shown, biases spindle 34 to the position shown in FIG. 2. Spindle 34 is provided with a pair of shoulders 38,40. An end of printing plate 16 fits over fixed edge 46 of housing 32. As later described, an end of printing plate 18 passes over edge 42 of housing 32 and fits over shoulder 40 of spindle 34. Leaf spring 44 presses against the end of printing plate 18 to firmly hold the leading end of printing plate 18 in position. FIG. 2 illustrates a fastener 45 for mounting leaf spring 44 to housing 32. This manner of mounting the printing plates is well known in the art. An alternative locking arrangement may utilize my invention of application serial no. 65,951 where the printing plate has a double bend to facilitate the printing plate being locked in place.

Figure 4:
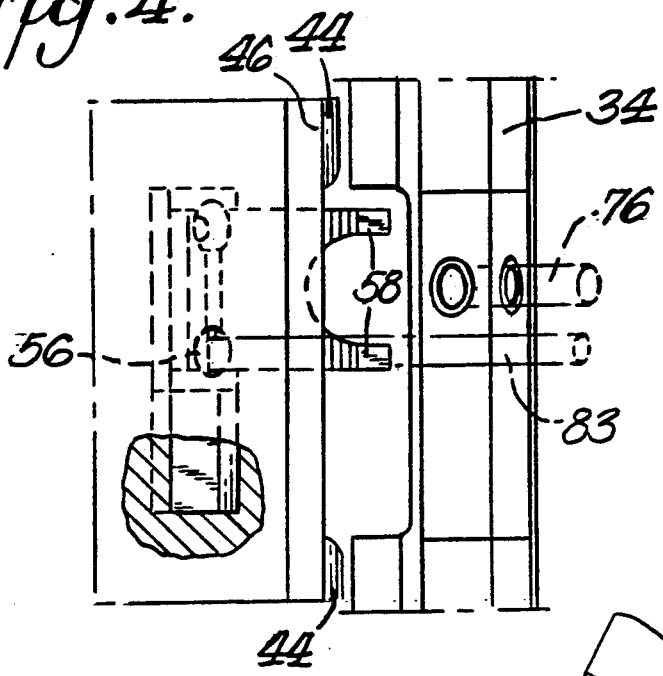
FIG. 4 is a top plan view, partly in section of the registration means in the printing press of FIGS. 1–3.

Each printing plate is held laterally in its proper position on plate cylinder 14 by registration means 50. Specifically, a registration means would be provided for each of the leading end and trailing end of each printing plate. In the embodiment of FIG. 1 where four printing plates are used, eight registration means 50 would be provided. Each registration means 50 is generally of the form which includes a registration plate 52 having an offset perpendicular flange or base portion 54 which is secured by fastener 56 to housing 32. The opposite end of registration plate 52 is in the form of a pair of pins or fingers 58. (See also FIG. 4).

It is to be understood that although the registration means is illustrated as centrally located, other locations can be used. Similarly structure other than pins or fingers may be used as long as the registration means includes structure which cooperates with complementary structure on the printing plate to properly locate or register the printing plate.

Figure 12:
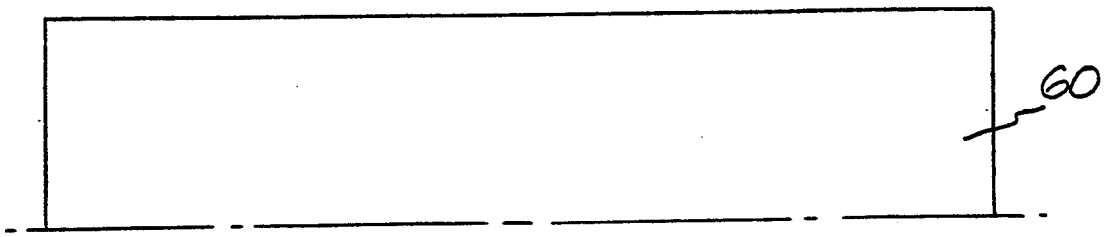
FIGS. 12–15 are front elevation views of portions of printing plates in accordance with this invention.
Figure 13:
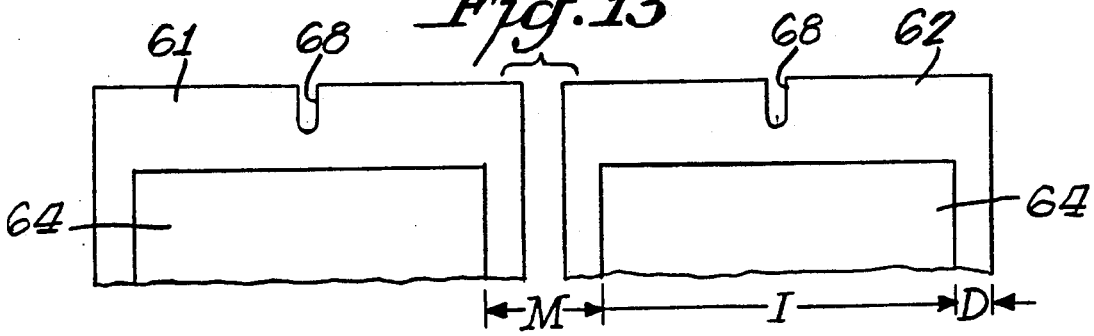

FIGS. 12–15 illustrate the problem with which the present invention is concerned. FIG. 12 shows a conventional newspaper 60 of standard width. The newspaper would have the material printed thereon from a pair of printing plates. For example, FIG. 13 illustrates a pair of printing plates 61,62 wherein the image or print area is indicated by the reference numerals 64,64. The leading edge and the trailing edge (not shown) of each plate would include a notched portion 68. The area of each plate 61,62 which contains the image 64 to be printed is indicated by the letter I. Each plate is provided with a side margin indicated by the letter D. The distance between adjacent printing areas is indicated by the letter M. Plates 61,62 would be used for printing two standard pages of a newspaper.

Figure 14:
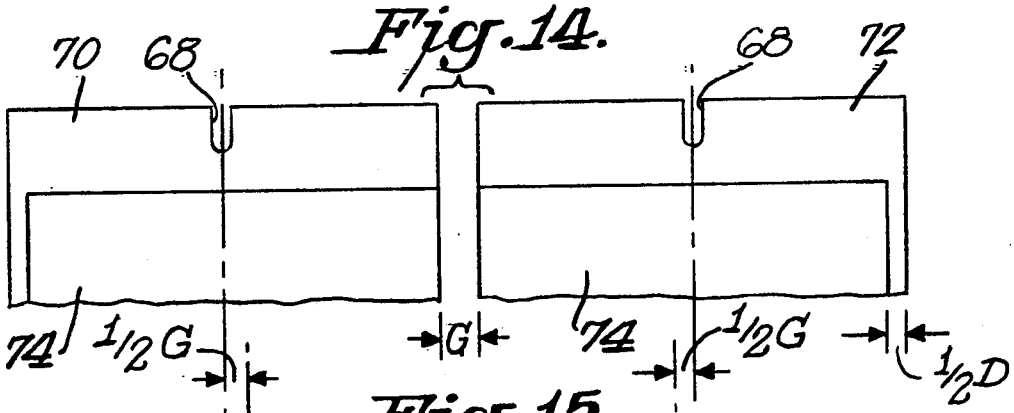
Figure 15:
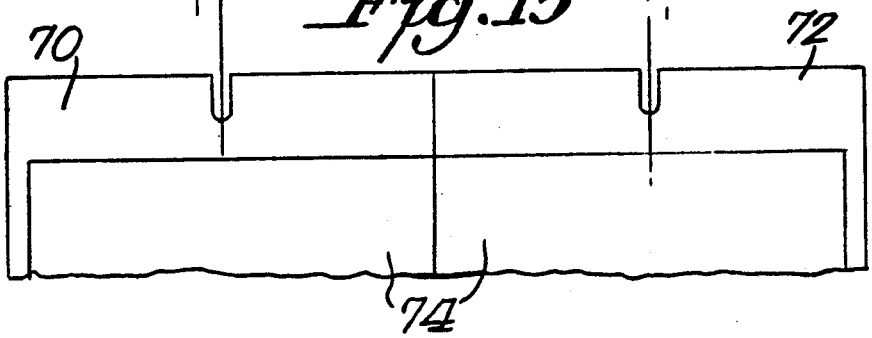

FIG. 14 illustrates a pair of plates 70,72 which are used for double truck printing corresponding to the center page or centerfold of the newspaper. Thus, as shown therein, the image area 74 terminates at the adjacent edges of the printing plate 70,72 and the outer margins are one-half of the standard margin which is provided on standard plate 61,62. In conventional practices great manual and equipment costs would be necessary to result in the center page of the newsprint 60 being such that the adjacent edges of the double truck image areas 74,74 abut against each other so as to give the appearance of a single printing plate being used. In fact, however, the edges are spaced apart by the distance G. The present invention avoids the problems of the prior art by laterally shifting the printing plate 70,72 as shown in FIG. 15 so that there is a physical abutment of the adjacent edges. This is done by shifting each plate one-half the distance G. In conventional printing arrangements this would correspond to a shifting of one-eighth inch where G is one-quarter inch.

Figure 3:
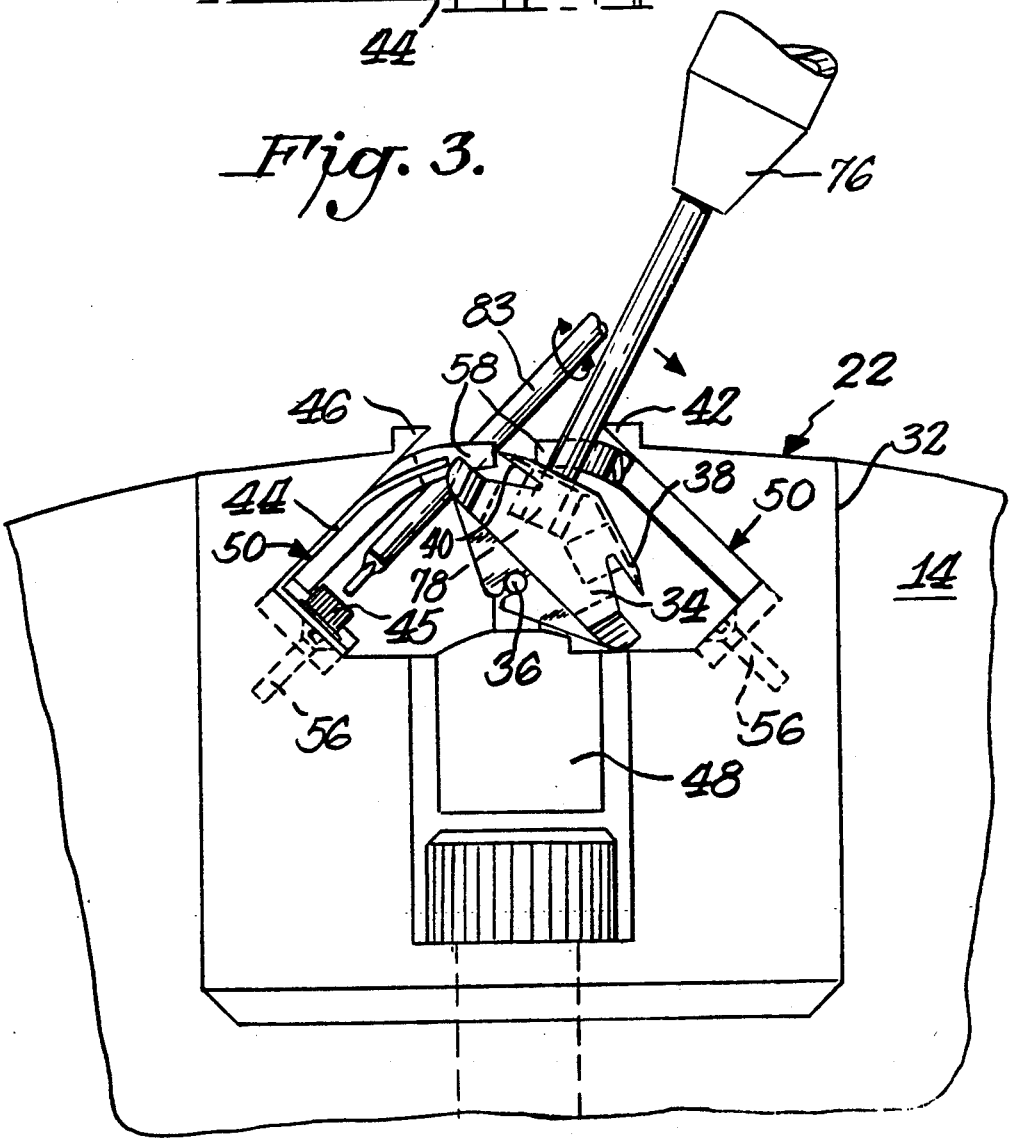
FIG. 3 is an end elevation view showing the manipulation of the registration means in the printing press of FIG. 1–2.
Figure 6:
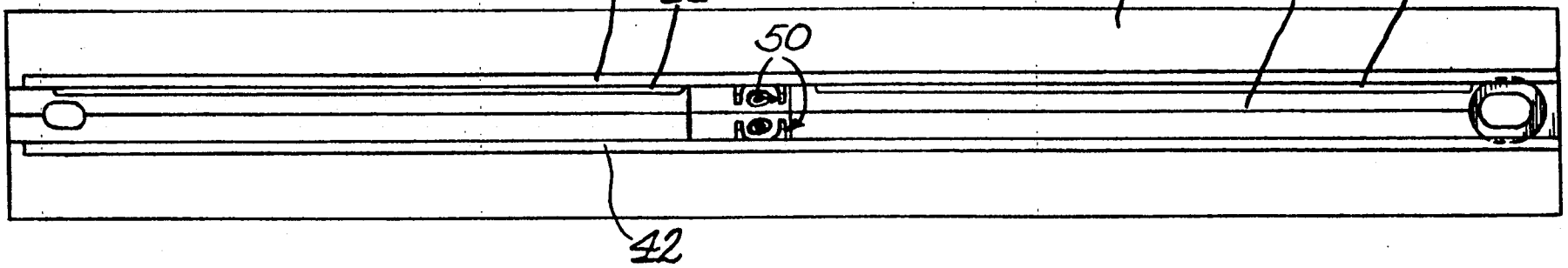
FIG. 6 is a top plan view of the plate lock shown in FIG. 5.
Figure 5:
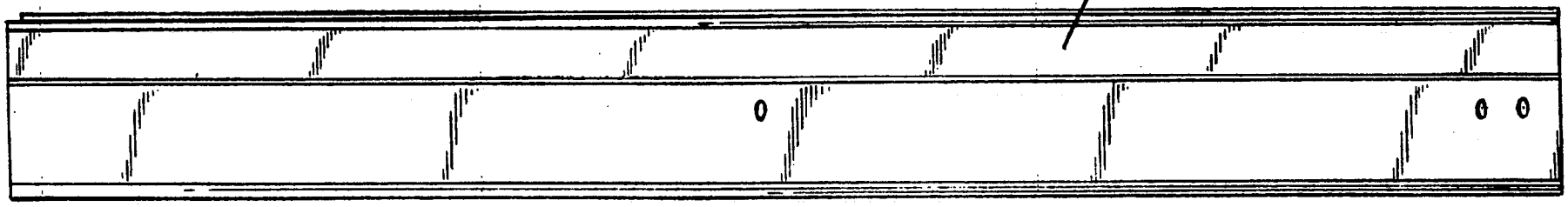
FIG. 5 is a front elevation view of a plate lock used in the printing press of FIGS. 1–4.

The following describes the method used for mounting printing plates on the plate cylinder 14. The bent leading edge of a printing plate such as printing plate 16 would be snapped over fixed edge 46 of lock housing 32 as illustrated in FIG. 2. The trailing edge would then be secured to the diametrically opposite plate lock 24. This would be accomplished by pivoting spindle 34. FIG. 3, for example, illustrates the insertion of the manipulating tool 76 in a recess 78 in spindle 34 which permits spindle 34 to be pivoted about shaft 36. The trailing edge of the printing plate would then be snapped over movable edge or shoulder 40 which is possible because of the slack resulting from the dimension of the printing plate being slightly longer than the arcuate distance from fixed edge 46 of one lock 24 to the diametrically opposite lock 24. After the trailing edge of plate 18 is mounted over movable edge 40 manipulating tool 76 is shifted in a counter-clockwise direction to permit the spring biased spindle 34 to return to its normal position which is illustrated in FIG. 2. During this motion, the slack is taken up and the printing plate is held in a taut condition. Each printing plate 16, 18, 20 and 22 would be mounted in this manner. During the positioning of each printing plate on the locks 24 the registration notch 68 of each printing plate is placed over the registration structure, such as pins or fingers 58 with the outer edges of each registration pin or finger contacting complementary structure, such as notch 68 since the width of each notch corresponds to the distance between the outer edges of each set of fingers 58. Accordingly, registration fingers 58 serve to properly orient or locate each printing plate on plate cylinder 14.

It is to be understood that the above manner of mounting the printing plates is known in the art. The invention, however, utilizes the concept of shifting the registration means to one of two fixed positions. One of the fixed positions would correspond to a spacing of the plates as shown in FIG. 13 wherein the plates 61,62 are spaced apart from each other for printing standard pages. The other of the two fixed positions would correspond to that of FIG. 15 wherein the plates are shifted toward each other so that the image areas 74 are in abutment. As a result, it would be possible to have the two image areas 74,74 contain continuous material 75 (see FIGS. 8 and 10) since the net result is to give the impression of one continuous sheet being printed rather than two separate sheets.

Figure 7:
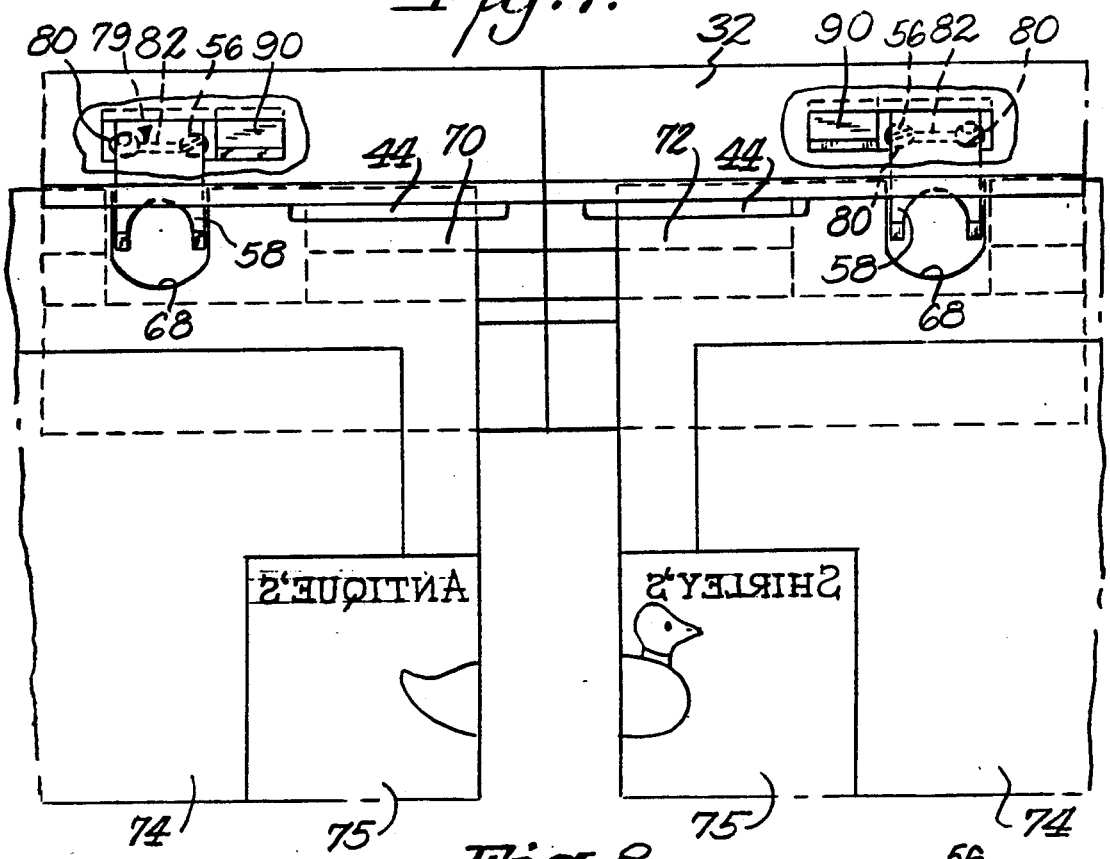
FIGS. 7–8 are front elevation views schematically shown the shifting of the registration means to two fixed positions.
Figure 8:
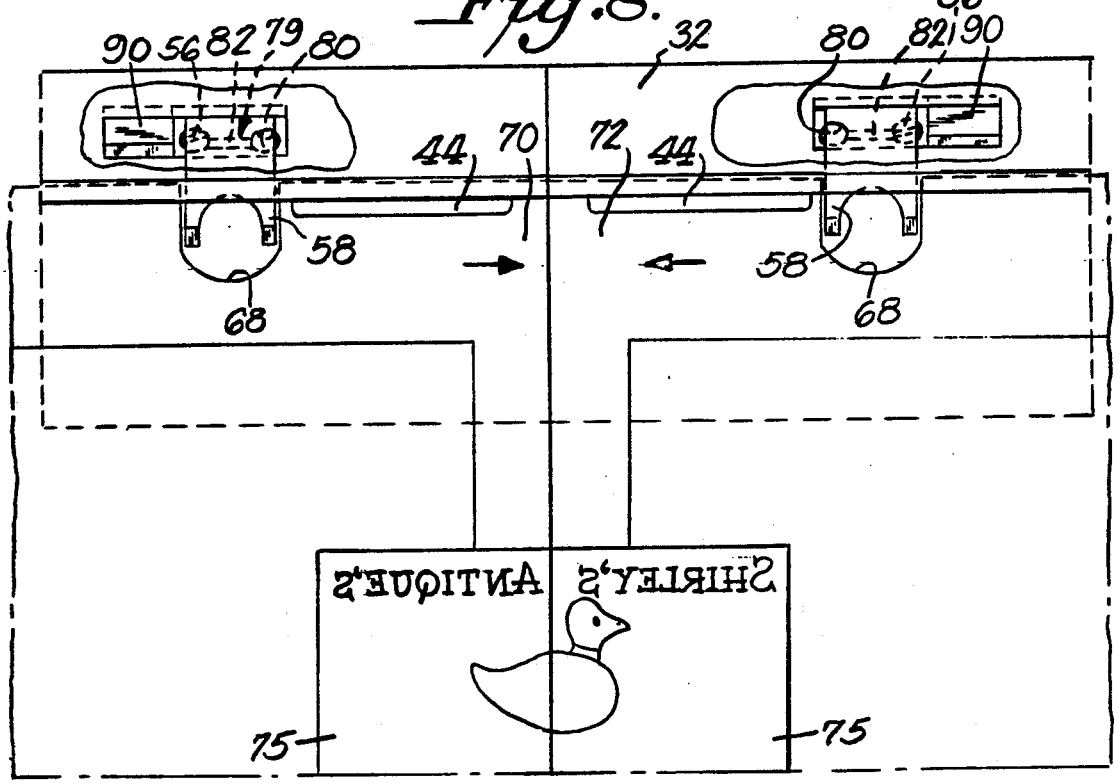

FIGS. 7–8 illustrate one embodiment for practicing this invention. As shown therein, base portion 54 of registration means 50 includes a track 79 formed by a pair of countersunk-counterbores 80,80 which are interconnected by a slot 82. Fastener 56 which may simply be a screw is dimensioned such that the diameter of its threaded portion generally corresponds to the width of slot 82 while the head portion of fastener 56 generally corresponds to the diameter of each countersink-counterbores 80,80. Accordingly, when fastener 56 is loosened the entire plate 52 may be laterally shifted until fastener 56 is in either of the countersunk-counterbores 80,80. When the fastener 56 is tightened the top surface of its head would be flush with base portion 54, as shown in FIG. 2. The distance between the countersunk-counterbores 80,80 would correspond to one-half G of the FIG. 14 embodiment so that a shifting of the registration means in the adjacent sets of locks 24,24 toward each other would result in the image areas 74,74 abutting against each other and have a continuous printed image 75. FIG. 7 illustrates the condition of plates 70,72 before the shifting, while FIG. 8 illustrates the condition of plates 70,72 after the shifting. In the illustrated embodiment access is had to fastener 56 by pivoting spindle 34 as illustrated in solid lines in FIG. 3 so that a screwdriver 83 or other manipulating tool may be inserted directly into the slotted head of fastener 56. Registration means 50 may then be shifted in any suitable manner such as by pushing against the exposed pins or fingers 58. Base portion 54 is mounted in recess 90 which also limits the extent of its sliding motion.

Figure 9:
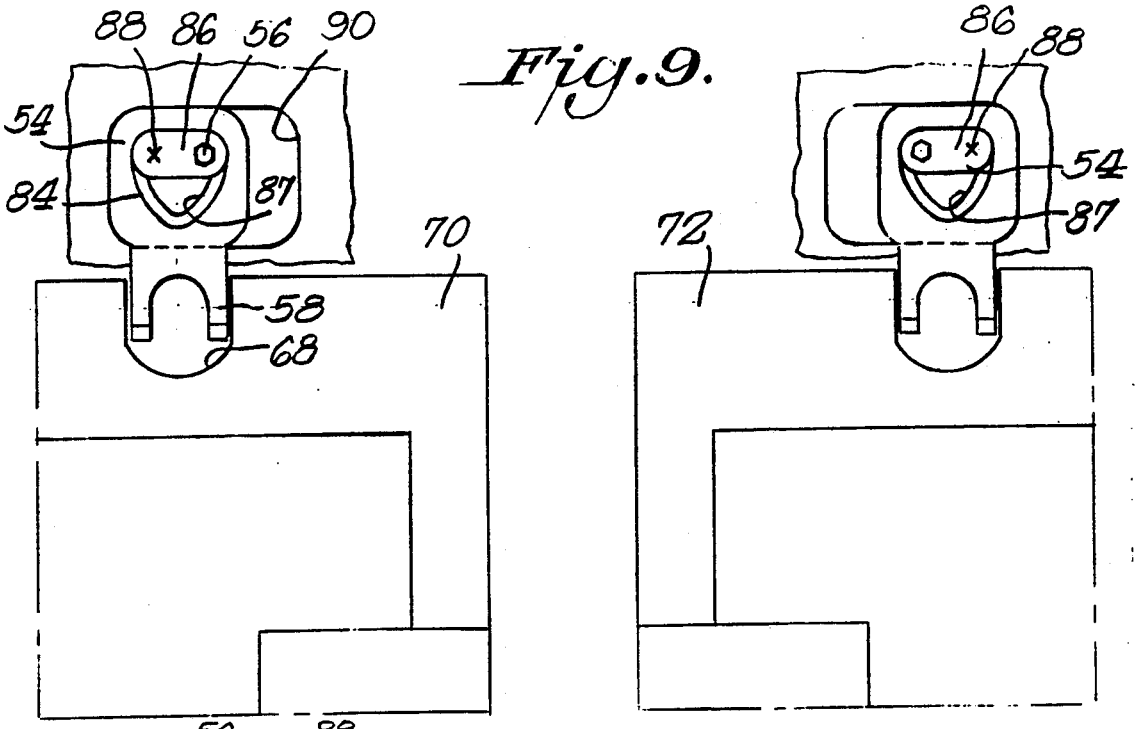
FIGS. 9–10 are views similar to FIGS. 7–8, but showing an alternative embodiment of this invention.
Figure 10:
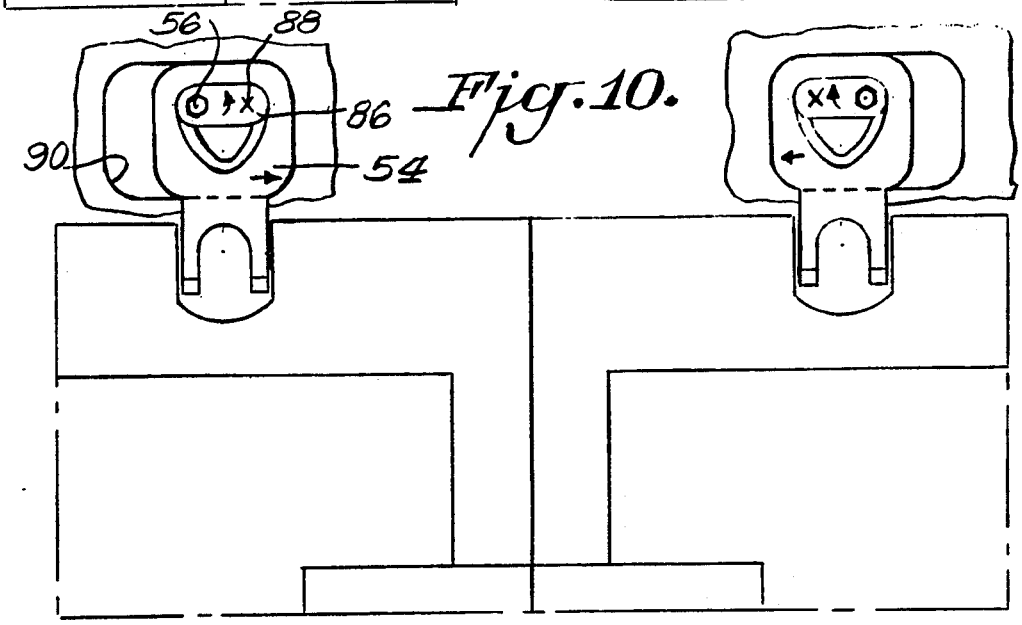
Figure 11:
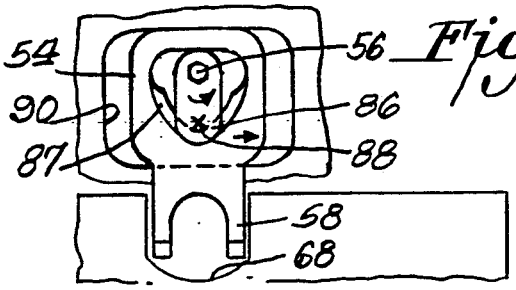
FIG. 11 is a view similar to FIGS. 9–10 showing an intermediate phase of operation.

FIGS. 9–11 illustrate an alternative manner of shifting the registration means. As shown therein in place of the holes and slot of the FIGS. 7–8 embodiment, a cam track 84 is provided which is formed by an irregular shaped hole or opening in base portion 54 of registration means 50. Fastener 56 would extend through a cam 86 riding in cam track 84. A semi-circular web or retainer 87 is in cam track 84 to orient cam 86 in its horizontal position. FIG. 9 illustrates the position of the various parts when the plates 70,72 are spaced apart as in FIG. 14. In this position cam 86 is located in contact with the upper edge of cam track 84 and in contact with retainer 87. In order to move plates 70,72 to their double truck or abutting position fastener 56 would be loosened and cam 86 would be rotated. Such rotation would be done in any suitable manner, such as inserting a manipulating tool into opening 88. FIG. 11 illustrates the intermediate position of cam 86 where cam 86 is completely over retainer 87. FIG. 10 illustrates the final position where cam 86 is again in contact with the upper edge -f cam track 84 and with retainer 87.

As shown in FIGS. 9–11 the fixed positions of registration means 50 is also determined by means of a slot 90 in which the registration plate 52 rides. Thus, in FIG. 9 registration plate 50 is at the outer most end of each slot 90 while in FIG. 10 the registration plates are at the inner most ends of each slot.

Figure 16:
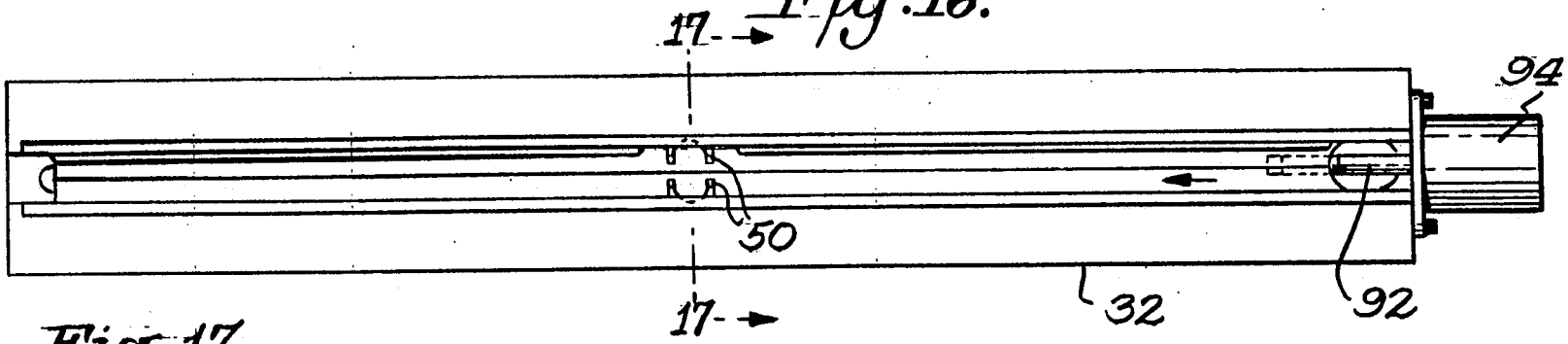
FIG. 16 is a top plan view similar to FIG. 6 of an alternative form of this invention.
Figure 17:
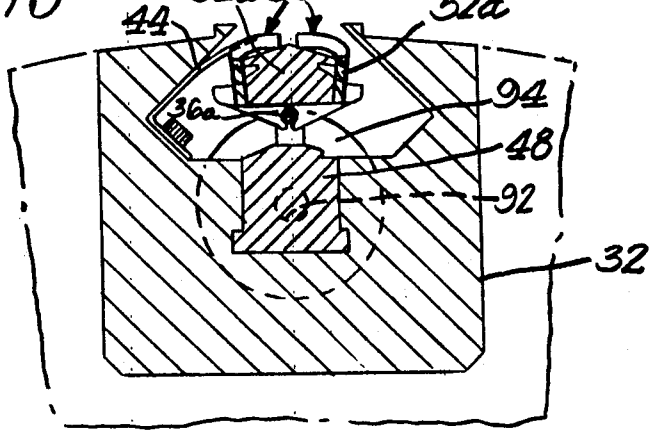
FIG. 17 is a cross-sectional view taken through FIG. 16 along the line 17—17.
Figure 18:
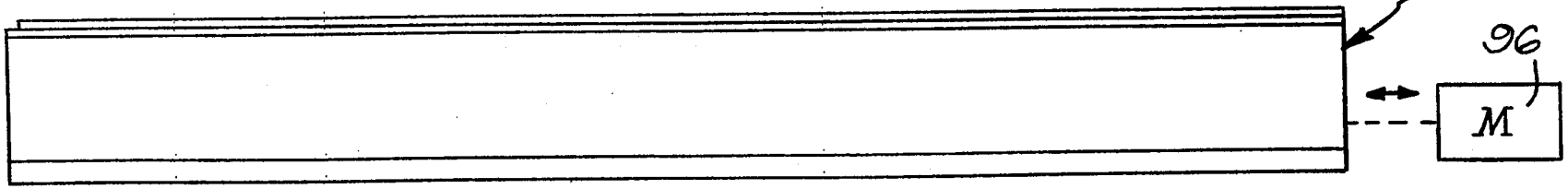
FIG. 18 is a side elevation view similar to FIG. 5 of yet a further embodiment of this invention.

Although this invention has been particularly described with respect to shifting the printing plates by shifting the registration means, such shift of the registration means may be accomplished in other manners such as illustrated in FIGS. 16–17 and FIG. 18.

FIGS. 16–17 illustrate a variation of the invention wherein the registration plates **52*a*,52*a* are mounted directly to the spindle 34*a* and thus differs from the previous embodiment where the registration means are mounted directly to the housing. In the embodiment of FIGS. 16–17 as in the previous embodiment spindle 34*a* is pivotally mounted on shaft 36*a* which in turn is secured to bar 48. Bar 48 of this modification, however, is mounted to threaded shaft 92 rotated by reversing motor 94. By controlling the direction of shift motor 94 shaft 92 will rotate so as to shift bar 48 laterally to and from the predetermined fixed positions. During this shifting movement the registration means is also shifted since the spindle 34*a* and registration means 50*a* are carried with bar 48**.

FIG. 18 schematically shows a variation wherein motor 96 is arranged to laterally shift the entire housing **32*a* to effect the shifting of the registration means. In the embodiment of FIG. 18** the registration means may be mounted to the housing as described with respect to the first embodiment.

Although the invention has been described with respect to two fixed positions, any number of predetermined plural positions may be used. Additionally, the invention may be practiced with two adjacent plates in the double truck position and the other adjacent plates used with the same plate locks still in the standard position. If necessary for a specialized printing operation the invention may be practiced by moving only one registration device.

As can be appreciated the present invention thereby provides a simple means wherein the same rotary printing press can be used for printing standard pages of a newspaper and then with a minor adjustment the printing plates can be moved into abutment with each other for the double truck printing operation. The standard and double truck printing plates can be processed through the same register trim, bender machine. No special equipment or additional manning is required to process double truck plates through platemaking or trim-bending the plates ready for press.

What is claimed is:

1. In a rotary printing press having a plate cylinder with two aligned locking means in a peripheral channel in the plate cylinder for releaseably locking a respective one of a pair of side by side printing plates to the plate cylinder, one of said locking devices being provided for each printing plate, and each locking means having registration means engaged with complementary registration structure in its printing plate for orienting its printing plate laterally on the plate cylinder, the improvement being in that a housing as in said channel for each of said locking means, an elongated spindle pivotally mounted to a bar in each of said housings, said registration means being secured to said spindle, means for shifting said bar and said spindle with said registration means to two positions, one of said two positions being a single truck position and the other of said two positions being a double truck position, said double truck positions of said two registration means being disposed toward each other and said single truck positions of said two registration means being disposed away from each other, the adjacent sides of said side by side printing plates being spaced from each other when both of said registration means are in their single truck positions for standard printing, and said adjacent sides of said side by side printing plates abutting each other when both of said registration means are in their double truck positions for double truck printing to permit the forming of a continuous joint image from said side by side printing plates.

2. In the printing press of claim 1 wherein said bar is secured to a threaded shaft, said threaded shaft being secured to and driven by a reversing motor, and said reversing motor controlling the direction of movement of said shaft to selectively move its registration means to said two positions.

3. In the printing press of claim 1 wherein said spindle has a shoulder which comprises a movable edge, and an end of its respective printing plate being mounted over said movable edge.

* * * * *